US010296031B2

(12) United States Patent
Kim

(10) Patent No.: US 10,296,031 B2
(45) Date of Patent: May 21, 2019

(54) REFERENCE VOLTAGE GENERATOR AND REFERENCE VOLTAGE GENERATOR FOR A SEMICONDUCTOR DEVICE

(71) Applicant: SK hynix Inc., Icheon-si, Gyeonggi-do (KR)

(72) Inventor: Young Koung Kim, Icheon-si (KR)

(73) Assignee: SK hynix Inc., Icheon-si, Gyeonggi-do (KR)

( * ) Notice: Subject to any disclaimer, the term of this patent is extended or adjusted under 35 U.S.C. 154(b) by 51 days.

(21) Appl. No.: 14/943,547

(22) Filed: Nov. 17, 2015

(65) Prior Publication Data

US 2016/0370820 A1 Dec. 22, 2016

(30) Foreign Application Priority Data

Jun. 17, 2015 (KR) ..... 10-2015-0085754

(51) Int. Cl.

| | |
|---|---|
| ***G05F 3/16*** | (2006.01) |
| *G05F 1/46* | (2006.01) |
| *G05F 3/24* | (2006.01) |

(52) U.S. Cl.

CPC ..... *G05F 3/16* (2013.01); *G05F 1/468* (2013.01); *G05F 3/24* (2013.01)

(58) Field of Classification Search

CPC ..... G05F 3/16; G05F 1/468; G05F 3/24
See application file for complete search history.

(56) References Cited

U.S. PATENT DOCUMENTS

| | | | | |
|---|---|---|---|---|
| 6,255,895 | B1 * | 7/2001 | Kim | G05F 1/465 327/525 |
| 6,396,339 | B1 * | 5/2002 | Jacobs | H03F 3/45179 330/256 |
| 8,638,006 | B2 * | 1/2014 | Im | G05F 1/56 307/18 |
| 2001/0011886 | A1 * | 8/2001 | Kobayashi | G05F 1/465 323/281 |
| 2007/0070723 | A1 * | 3/2007 | Kang | G11C 5/147 365/189.09 |
| 2008/0042738 | A1 * | 2/2008 | Kang | G05F 1/465 327/540 |
| 2008/0087085 | A1 * | 4/2008 | Ueda | G01P 15/0891 73/514.32 |
| 2009/0207065 | A1 * | 8/2009 | Kim | H03K 5/2481 341/159 |
| 2010/0301830 | A1 * | 12/2010 | Wang | G11C 16/22 323/311 |

(Continued)

FOREIGN PATENT DOCUMENTS

| | | | |
|---|---|---|---|
| KR | 1020010060478 | A | 7/2001 |
| KR | 1020120121732 | A | 11/2012 |

*Primary Examiner* — Fred E Finch, III
*Assistant Examiner* — Demetries A Gibson
(74) *Attorney, Agent, or Firm* — William Park & Associates Ltd.

(57) ABSTRACT

A reference voltage generator may include a voltage division unit configured to receive an external voltage, and divide the external voltage into a plurality of divided voltages. The reference voltage generator may include reference voltage output units configured to trim the divided voltages received from the voltage division unit according to a division control signal, and output supply reference voltages. The reference voltage output units may be symmetrically arranged at both sides of the voltage division unit.

14 Claims, 4 Drawing Sheets

(56) References Cited

U.S. PATENT DOCUMENTS

| | | | | |
|---|---|---|---|---|
| 2011/0187444 | A1* | 8/2011 | Jin | G05F 3/02 327/538 |
| 2011/0210780 | A1* | 9/2011 | Ko | G06F 1/10 327/306 |
| 2012/0105142 | A1* | 5/2012 | Im | G05F 1/56 327/543 |
| 2012/0256675 | A1* | 10/2012 | Lee | G11C 5/147 327/333 |
| 2013/0162342 | A1* | 6/2013 | Song | G11C 5/147 327/543 |
| 2013/0265344 | A1* | 10/2013 | Taniguchi | G09G 3/3696 345/690 |
| 2014/0062452 | A1* | 3/2014 | Ok | G05F 3/24 323/313 |
| 2016/0182025 | A1* | 6/2016 | Ok | H03K 5/08 327/309 |

* cited by examiner

<Prior Art>

REFERENCE VOLTAGE GENERATOR AND REFERENCE VOLTAGE GENERATOR FOR A SEMICONDUCTOR DEVICE

CROSS-REFERENCE TO RELATED APPLICATION

The priority of Korean patent application No. 10-2015-0085754 filed on 17 Jun. 2015, the disclosure of which is hereby incorporated in its entirety by reference, is claimed.

BACKGROUND

1. Technical Field

Embodiments of the present disclosure generally relate to a reference voltage generator for a semiconductor device, and, more particularly, to a reference voltage generator.

2. Related Art

Generally, a voltage generation circuit configured to generate a predetermined-level voltage is mounted to a semiconductor device. When the voltage generation circuit outputs a voltage, the actual output voltage must be identical in level to a target voltage, however, unexpected errors occur due to various reasons. For example, the unexpected errors are sometimes caused by errors in the fabrication process or device, or inaccuracy of a device model parameter, etc.

Therefore, the voltage generation circuit for the semiconductor device includes a trimming circuit configured to adjust circuit characteristics in such a manner that an output voltage level is identical to a target voltage level. A trimming circuit is included in a reference voltage generator configured to generate a reference voltage.

However, a conventional reference voltage trimming circuit block (Conventional VREF TRIM Block) for trimming a reference voltage must include 800 lines arranged in a horizontal direction and 130 lines arranged in a vertical direction as illustrated in FIG. 1. Since many lines are formed in a limited space, a bottleneck of lines may occur.

SUMMARY

In accordance with an embodiment, a reference voltage generator for a semiconductor device may include a voltage division unit configured to receive an external voltage, and divide the external voltage into a plurality of divided voltages. The reference voltage generator may include reference voltage output units configured to trim the divided voltages received from the voltage division unit according to a division control signal, and output supply reference voltages. The reference voltage output units may be symmetrically arranged at both sides of the voltage division unit.

In accordance with an embodiment, a reference voltage generator may include a voltage division unit configured to receive an external voltage, and divide the external voltage into a plurality of divided voltages. The reference voltage generator may include reference voltage output units configured to trim the divided voltages received from the voltage division unit according to a division control signal, and output supply reference voltages. The reference voltage output units may be symmetrically arranged at both sides of the voltage division unit.

In accordance with an embodiment, a reference voltage generator for a semiconductor device may include a voltage division unit configured to receive an external voltage, and divide the external voltage into a plurality of divided voltages. The reference voltage generator may include reference voltage output units configured to trim the divided voltages received from the voltage division unit according to a division control signal, and output supply reference voltages. A reference voltage output unit may be arranged at a first side of the voltage division unit and another reference voltage output unit may be arranged at a second side opposite to the first side of the voltage division unit. One half of a total number of lines for the reference voltage output units may be coupled to the reference voltage output units of the first side located on the first side of the voltage division unit and the other half of the total number of the lines for the reference voltage output units may be coupled to the reference voltage output units of the second side are located on the second side opposite to the first side of the voltage division unit.

DETAILED DESCRIPTION

Reference will now be made to various embodiments, examples of which are illustrated in the accompanying drawings. Wherever possible, the same reference numbers will be used throughout the drawings to refer to the same or like parts. In the following description, a detailed description of related known configurations or functions incorporated herein will be omitted when it may make the subject matter less clear.

Various embodiments of the present disclosure may be directed to providing a reference voltage generator for a semiconductor device that substantially obviates one or more problems due to limitations and disadvantages of the related art.

Due to the limitations of the prior art, there may be needed a new layout structure in which the size of a region occupied by the trimming circuit may be minimized and the occurrence of a bottleneck of lines may be prevented.

An embodiment of the present disclosure may relate to a technology for improving a layout structure of a reference voltage trimming circuit configured to trim a reference voltage level in a reference voltage generator, such that the occurrence of a bottleneck of lines may be prevented.

Figure 1:
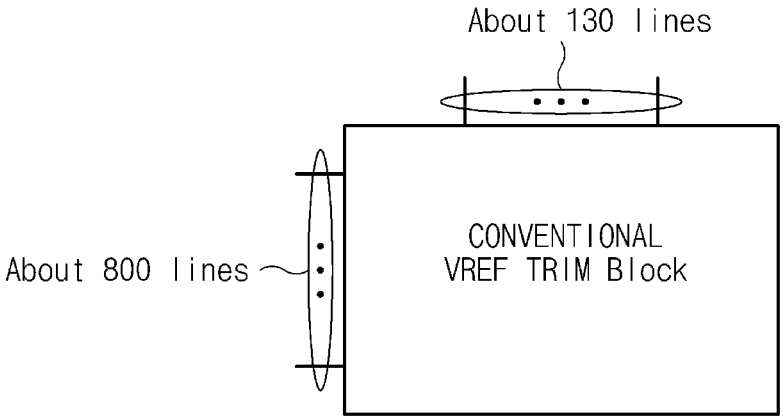
FIG. 1 is a schematic view illustrating the number of lines requisite for a conventional reference voltage generator.
Figure 2:
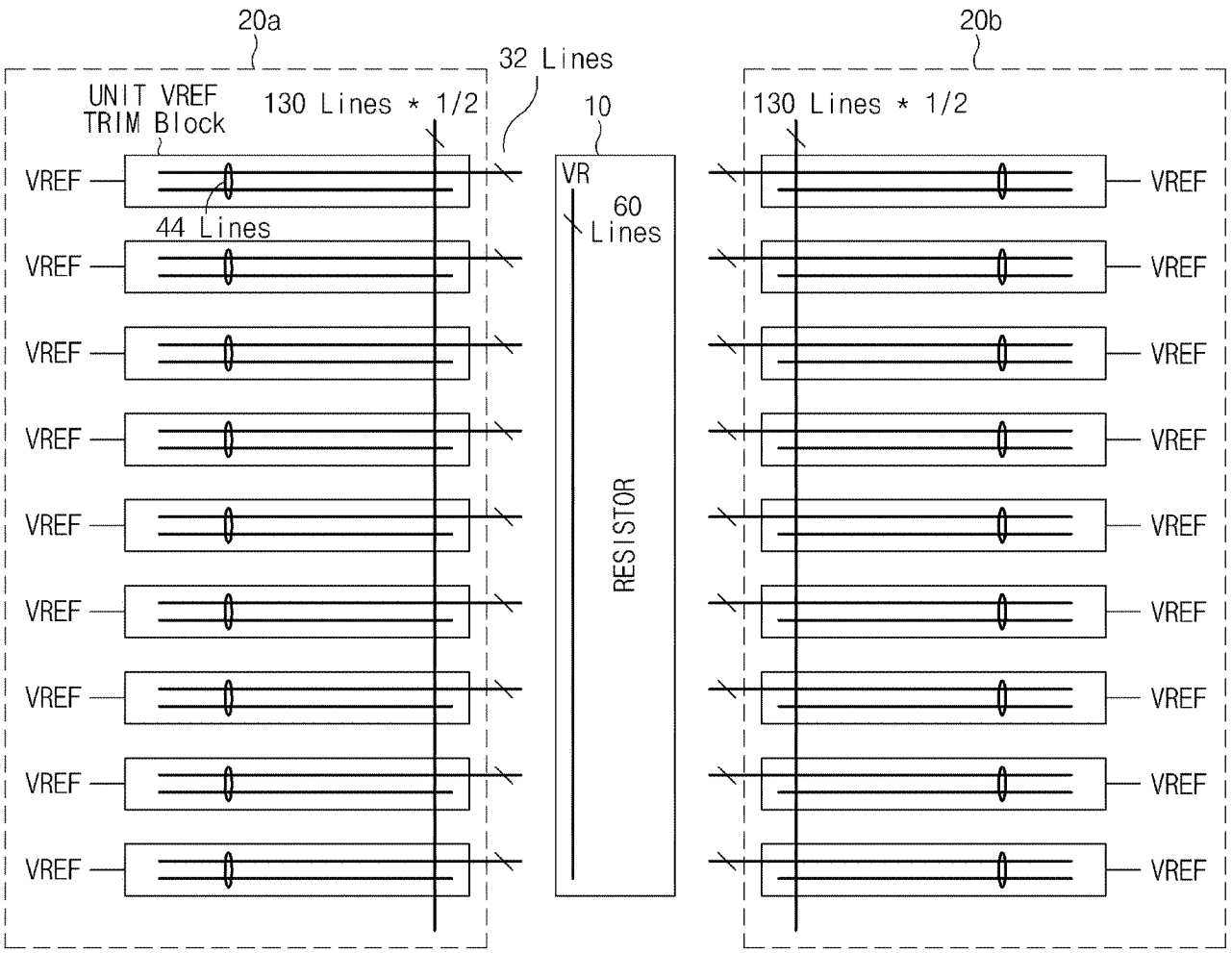
FIG. 2 is a layout structure illustrating a representation of an example of a reference voltage generator (VREF TRIM Block) according to an embodiment.

FIG. 2 is a layout structure illustrating a reference voltage generator (i.e., reference voltage trimming circuit block VREF TRIM Block) according to an embodiment of the present disclosure.

Referring to FIG. 2, a reference voltage generator according to an embodiment of the present disclosure may include a voltage division unit 10 and reference voltage output units (20*a*, 20*b*).

The voltage division unit 10 receives an external voltage (VR), divides the received external voltage (VR), and outputs the divided voltages to the reference voltage output units (20*a*, 20*b*). For example, the voltage division unit 10 may receive a plurality of external voltages, and may divide each external voltage into 32-step voltages. The voltage division unit 10 may include a plurality of resistors coupled in series to each other, and output the divided voltages at respective nodes (output nodes) coupled to the resistors. The voltage division unit 10 may be vertically arranged at the center portion of the reference voltage trimming circuit block (VREF TRIM Block). 60 or about 60 local lines for interconnecting the resistors in series to one another may be arranged parallel to one another in a vertical direction.

The reference voltage output units (20*a*, 20*b*) may trim the divided voltages received from the voltage division unit 10 according to a division control signal, and may output the supply reference voltages (VREF). The reference voltage output units (20*a*, 20*b*) may include a plurality of unit reference voltage trimming blocks (UNIT VREF TRIM Blocks) configured to trim the divided voltages received from the voltage division unit 10 according to the division control signal to output a single supply reference voltage (VREF). The reference voltage generator may include 18 unit reference voltage trimming blocks (UNIT VREF TRIM Blocks). In these examples, the unit reference voltage trimming blocks (UNIT VREF TRIM Blocks) of the reference voltage output units (20*a*, 20*b*) may be symmetrically arranged at both sides of the voltage division unit 10. For example, 9 unit reference voltage trimming blocks (UNIT VREF TRIM Blocks) of the reference voltage output unit 20*a* and 9 unit reference voltage trimming blocks (UNIT VREF TRIM Blocks) of the reference voltage output unit 20*b* may respectively be symmetrically arranged at the left and right sides of the voltage division unit 10.

In these examples, each unit reference voltage trimming block (UNIT VREF TRIM Block) may include 44 lines which are coupled to the output nodes of the voltage division unit 10 as well as to receive the division control signal. For example, 44 lines may be arranged in parallel or substantially in parallel to one another in each unit reference voltage trimming block (UNIT VREF TRIM Block). For example, each unit reference voltage trimming block (UNIT VREF TRIM Block) may include not only 32 lines coupled to the output nodes of the voltage division unit 10, but also 12 lines configured to receive the division control signal for voltage trimming. For example, 32 lines and 12 lines may be horizontally arranged or substantially horizontally arranged in each unit reference voltage trimming block (UNIT VREF TRIM Block). In an embodiment, for example, each unit reference voltage trimming block (UNIT VREF TRIM Block) may include not only a number of first lines coupled to the output nodes of the voltage division unit 10, but also a number of second lines configured to receive the division control signal for voltage trimming. For example, the first lines and the second lines may be horizontally arranged or substantially horizontally arranged in each unit reference voltage trimming block (UNIT VREF TRIM Block).

Symmetrical blocks (i.e., the unit reference voltage trimming block (UNIT VREF TRIM Block) of the reference voltage output unit 20*a* and the unit reference voltage trimming block (UNIT VREF TRIM Block) of the reference voltage output unit 20*b*) from among the unit reference voltage trimming blocks (UNIT VREF TRIM Blocks) may be coupled to the same output nodes of the voltage division unit 10. In addition, the unit reference voltage trimming blocks (UNIT VREF TRIM Blocks) symmetrically arranged in a horizontal direction may be located at the same lines.

As described above, since the reference voltage output units (20*a*, 20*b*) may be symmetrically arranged at the left and right sides of the voltage division unit 10, the number of channels arranged in a horizontal direction may be cut in half, resulting in reduction of an overall chip size.

In addition, a number of about 130 lines or 130 lines vertically arranged or substantially vertically arranged to be coupled to other blocks (i.e., other unit reference voltage trimming blocks) in the reference voltage generator may be divided into two equal halves, such that the two equal halves may respectively be arranged at both sides of the voltage division unit 10.

Figure 3:
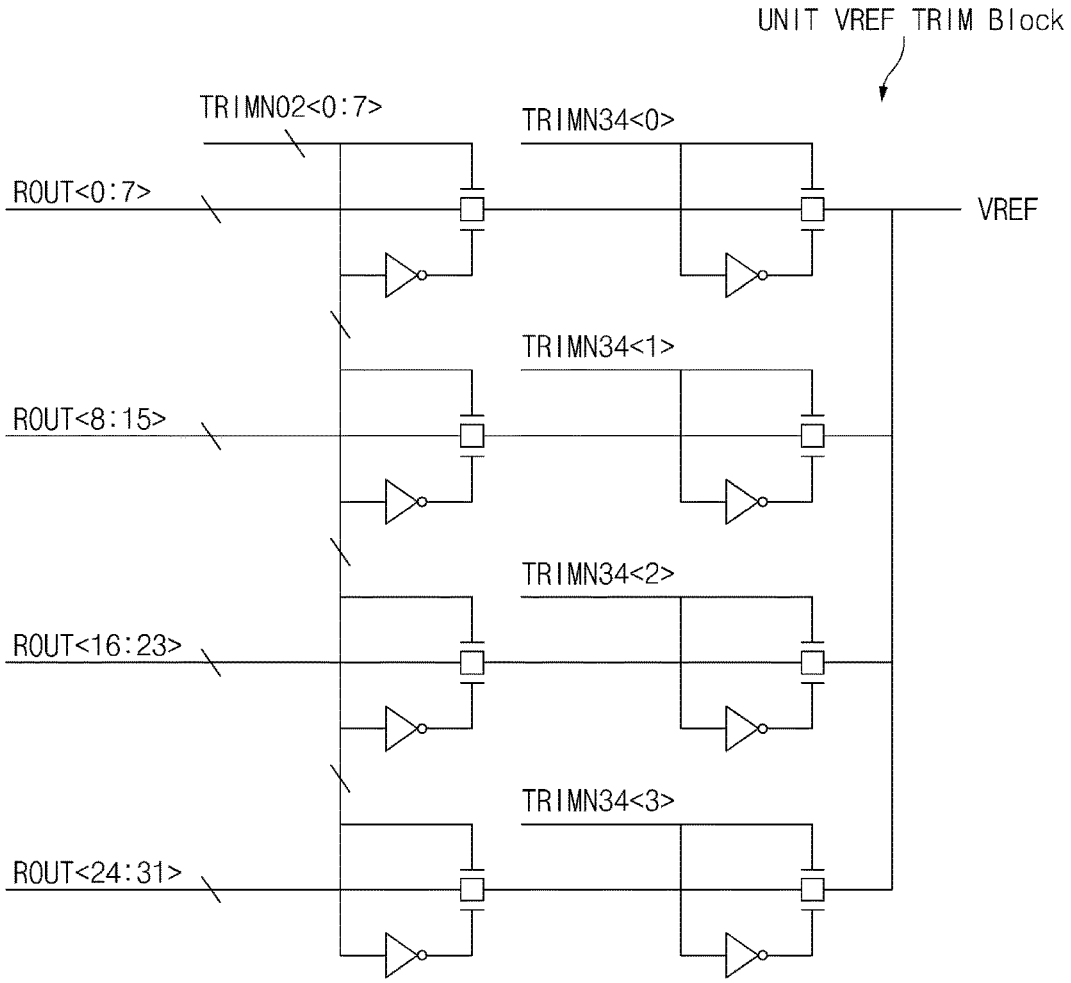
FIG. 3 is a circuit diagram illustrating a representation of an example of an internal circuit structure of each unit reference voltage trimming block (UNIT VREF TRIM Block) illustrated in FIG. 2.

FIG. 3 is a circuit diagram illustrating an internal circuit structure of each unit reference voltage trimming block (UNIT VREF TRIM Block) illustrated in FIG. 2.

Referring to FIG. 3, each unit reference voltage trimming block (UNIT VREF TRIM Block) may output any one of the voltage level values ROUT<0:31> received from the output nodes of the voltage division unit 10 as the supply reference voltage (VREF) according to the division control signals (i.e., TRIM02<0:7>, TRIMN34<0>~TRIMN34<3>). For example, the unit reference voltage trimming block may divide voltage level values ROUT<0:31> received from the output nodes of the voltage division unit 10 into four groups (ROUT<0:7>, ROUT<8:15>, ROUT<16:23>, ROUT<24:31>), each of which may include 8 voltage level values. Thereafter, the unit reference voltage trimming block may control specific information indicating whether the divided signals are output (i.e., whether the divided signals pass through a transfer gate) using the division control signals (TRIMN02<0:7>, TRIMN34<0>~TRIMN34<3>), and may thus output any one of the voltage level values ROUT<0:31> as the reference voltage (VREF).

For this purpose, each unit reference voltage trimming block may include not only 32 lines ROUT<0:31> coupled to the output nodes of the voltage division unit 10 but also 12 lines (i.e., TRIMN02<0:7>, TRIMN34<0>~TRIMN34<3>) configured to receive the division control signal. That is, for example, each unit reference voltage trimming block may include 44 lines coupled to the output nodes of the voltage division unit 10 as well as to receive the division control signal, as illustrated in FIG. 2. In an embodiment, the 12 lines (i.e., TRIMN02<0:7>, TRIMN34<0>~TRIMN34<3>) may be coupled to the 32 lines, respectively, through various circuitry, for example but not limited to the circuitry illustrated in FIG. 3.

As is apparent from the above description, the reference voltage generator according to the embodiments may improve a layout structure of a reference voltage trimming circuit configured to trim a reference voltage level, such that the occurrence of a bottleneck, due to a plurality of lines, may be prevented.

Those skilled in the art will appreciate that embodiments of the present disclosure may be carried out in other ways than those set forth herein without departing from the spirit and essential characteristics of these embodiments. The above embodiments are therefore to be construed in all aspects as illustrative and not restrictive.

Figure 4:
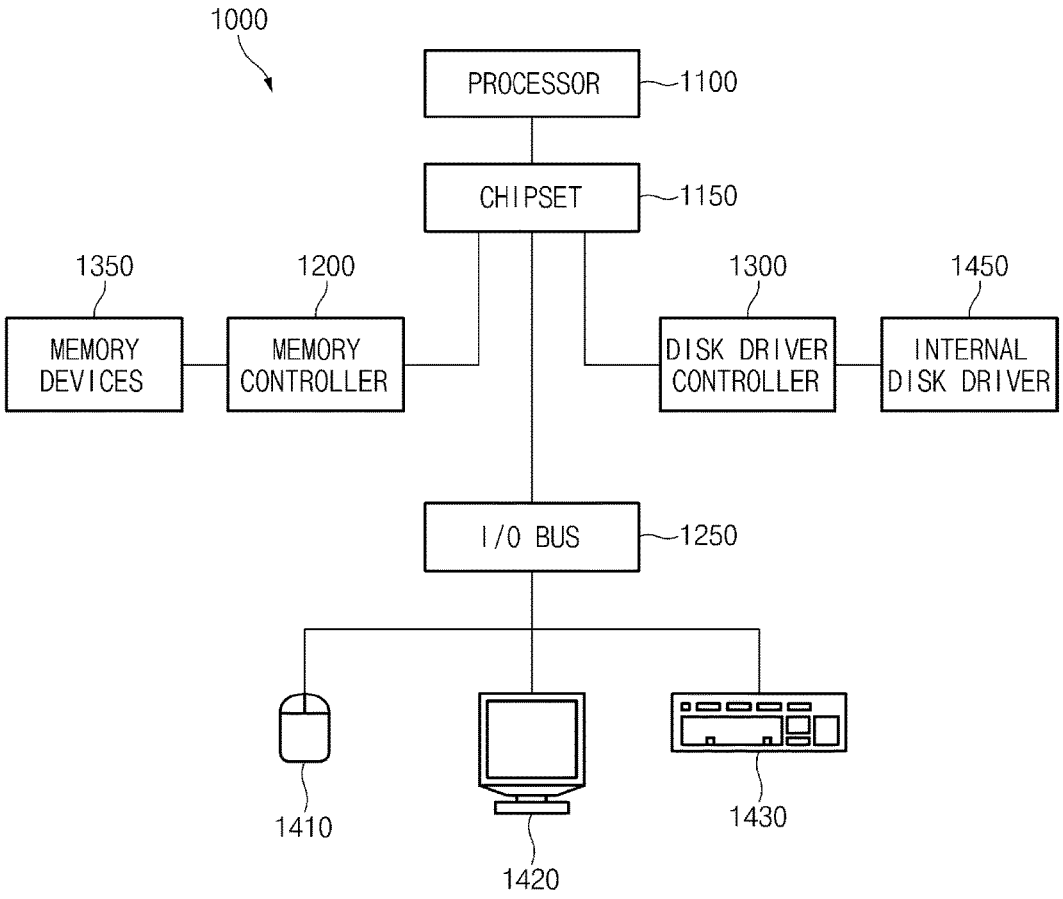
FIG. 4 illustrates a block diagram of an example of a representation of a system employing a reference voltage generator in accordance with the various embodiments discussed above with relation to FIGS. 2-3.

The reference voltage generator discussed above (see FIGS. 2-3) are particular useful in the design of memory devices, processors, and computer systems. For example, referring to FIG. 4, a block diagram of a system employing a reference voltage generator in accordance with the various embodiments are illustrated and generally designated by a reference numeral 1000. The system 1000 may include one or more processors (i.e., Processor) or, for example but not limited to, central processing units ("CPUs") 1100. The processor (i.e., CPU) 1100 may be used individually or in combination with other processors (i.e., CPUs). While the processor (i.e., CPU) 1100 will be referred to primarily in the singular, it will be understood by those skilled in the art that a system 1000 with any number of physical or logical processors (i.e., CPUs) may be implemented.

A chipset 1150 may be operably coupled to the processor (i.e., CPU) 1100. The chipset 1150 is a communication pathway for signals between the processor (i.e., CPU) 1100 and other components of the system 1000. Other components of the system 1000 may include a memory controller 1200, an input/output ("I/O") bus 1250, and a disk driver controller 1300. Depending on the configuration of the system 1000, any one of a number of different signals may be transmitted through the chipset 1150, and those skilled in the art will appreciate that the routing of the signals throughout the system 1000 can be readily adjusted without changing the underlying nature of the system 1000.

As stated above, the memory controller 1200 may be operably coupled to the chipset 1150. The memory controller 1200 may include at least one reference voltage generator as discussed above with reference to FIGS. 2-3. Thus, the memory controller 1200 can receive a request provided from the processor (i.e., CPU) 1100, through the chipset 1150. In alternate embodiments, the memory controller 1200 may be integrated into the chipset 1150. The memory controller 1200 may be operably coupled to one or more memory devices 1350. In an embodiment, the memory devices 1350 may include the at least one reference voltage generator as discussed above with relation to FIGS. 2-3, the memory devices 1350 may include a plurality of word lines and a plurality of bit lines for defining a plurality of memory cells. The memory devices 1350 may be any one of a number of industry standard memory types, including but not limited to, single inline memory modules ("SIMMs") and dual inline memory modules ("DIMMs"). Further, the memory devices 1350 may facilitate the safe removal of the external data storage devices by storing both instructions and data.

The chipset 1150 may also be coupled to the I/O bus 1250. The I/O bus 1250 may serve as a communication pathway for signals from the chipset 1150 to I/O devices 1410, 1420, and 1430. The I/O devices 1410, 1420, and 1430 may include, for example but are not limited to, a mouse 1410, a video display 1420, or a keyboard 1430. The I/O bus 1250 may employ any one of a number of communications protocols to communicate with the I/O devices 1410, 1420, and 1430. In an embodiment, the I/O bus 1250 may be integrated into the chipset 1150.

The disk driver controller 1300 may be operably coupled to the chipset 1150. The disk driver controller 1300 may serve as the communication pathway between the chipset 1150 and one internal disk driver 1450 or more than one internal disk driver 1450. The internal disk driver 1450 may facilitate disconnection of the external data storage devices by storing both instructions and data. The disk driver controller 1300 and the internal disk driver 1450 may communicate with each other or with the chipset 1150 using virtually any type of communication protocol, including, for example but not limited to, all of those mentioned above with regard to the I/O bus 1250.

It is important to note that the system 1000 described above in relation to FIG. 4 is merely one example of a system 1000 employing a reference voltage generator as discussed above with relation to FIGS. 2-3. In alternate embodiments, such as, for example but not limited to, cellular phones or digital cameras, the components may differ from the embodiments illustrated in FIG. 4.

The above embodiments of the present disclosure are illustrative and not limitative. Various alternatives and equivalents are possible. The embodiments are not limited by the type of deposition, etching polishing, and patterning steps described herein. Nor are the embodiments limited to any specific type of semiconductor device. For example, the present disclosure may be implemented in a dynamic random access memory (DRAM) device or non volatile memory device. Other additions, subtractions, or modifications are obvious in view of the present disclosure and are intended to fall within the scope of the appended claims.

What is claimed is:

1. A reference voltage generator for a semiconductor device comprising:

a voltage division unit configured to receive an external voltage, and divide the external voltage into a plurality of divided voltages; and reference voltage output units configured to trim the divided voltages received from the voltage division unit according to a division control signal, and output supply reference voltages, wherein the reference voltage output units are physically symmetrically arranged at both sides of the voltage division unit, wherein the reference voltage output unit includes a plurality of unit reference voltage trimming blocks configured to trim the divided voltages received from the voltage division unit according to the division control signal such that each unit reference voltage trimming block outputs one supply reference voltage, wherein the unit reference voltage trimming block includes:

a plurality of first lines arranged in a first direction, and coupled to output nodes of the voltage division unit;

a plurality of second lines arranged in the first direction and configured to transmit there through the division control signal; and a plurality of third lines arranged in a second direction and coupled to, respective, unit reference voltage trimming blocks.

2. The reference voltage generator according to claim 1, wherein the reference voltage output unit includes 18 unit reference voltage trimming blocks symmetrically arranged at both sides of the voltage division unit.

3. The reference voltage generator according to claim 1, wherein the unit reference voltage trimming blocks symmetrically arranged at left and right sides of the voltage division unit are coupled to the same output node of the voltage division unit.

4. The reference voltage generator according to claim 1, wherein each reference voltage trimming block includes 32 first lines and 12 second lines.

5. The reference voltage generator according to claim 1, wherein one half of a total number of the third lines is arranged on one side of the voltage division unit and a second half of the total number of the third lines is arranged on the other side of the voltage division unit.

6. The reference voltage generator according to claim 1, wherein the voltage division unit includes:

a plurality of resistors coupled in series to one another.

7. A reference voltage generator comprising:

a voltage division unit configured to receive an external voltage, and divide the received external voltage into a plurality of divided voltages; and reference voltage output units configured to trim the divided voltages received from the voltage division unit according to a division control signal, and output supply reference voltages, wherein the reference voltage output units are physically symmetrically arranged at both sides of the voltage division unit, wherein the reference voltage output unit includes a plurality of unit reference voltage trimming blocks configured to trim the divided voltages received from the voltage division unit according to the division control signal such that each unit reference voltage trimming block outputs one supply reference voltage, wherein the unit reference voltage trimming block includes:

a plurality of first lines arranged in a first direction, and coupled to output nodes of the voltage division unit;

a plurality of second lines arranged in the first direction and configured to transmit there through the division control signal; and a plurality of third lines arranged in a second direction and coupled to, respective, unit reference voltage trimming blocks.

8. The reference voltage generator according to claim 7, wherein the reference voltage output unit includes 18 unit reference voltage trimming blocks symmetrically arranged at both sides of the voltage division unit.

9. The reference voltage generator according to claim 7, wherein the unit reference voltage trimming blocks symmetrically arranged at left and right sides of the voltage division unit are coupled to the same output node of the voltage division unit.

10. The reference voltage generator according to claim 7, wherein each reference voltage trimming block includes 32 first lines and 12 second lines.

11. The reference voltage generator according to claim 7, wherein one half of a total number of the third lines is arranged on one side of the voltage division unit and a second half of the total number of the third lines is arranged on the other side of the voltage division unit.

12. The reference voltage generator according to claim 7, wherein the voltage division unit includes:

a plurality of resistors coupled in series to one another.

13. A reference voltage generator comprising:

a voltage division unit configured to receive an external voltage, and divide the external voltage into a plurality of divided voltages; and reference voltage output units configured to trim the divided voltages received from the voltage division unit according to a division control signal, and output supply reference voltages, wherein a reference voltage output unit is physically arranged at a first side of the voltage division unit and another reference voltage output unit is physically arranged at a second side opposite to the first side of the voltage division unit, and wherein one half of a total number of lines for the reference voltage output units are coupled to the reference voltage output units of the first side located on the first side of the voltage division unit and the other half of the total number of the lines for the reference voltage output units are coupled to the reference voltage output units of the second side are located on the second side opposite to the first side of the voltage division unit, wherein the reference voltage output unit includes a plurality of unit reference voltage trimming blocks configured to trim the divided voltages received from the voltage division unit according to the division control signal such that each unit reference voltage trimming block outputs one supply reference voltage, wherein the unit reference voltage trimming block includes:

a plurality of first lines arranged in a first direction, and coupled to output nodes of the voltage division unit;

a plurality of second lines arranged in the first direction and configured to transmit there through the division control signal; and a plurality of third lines arranged in a second direction and coupled to, respective, unit reference voltage trimming blocks.

14. The reference voltage generator according to claim 13, wherein the reference voltage output units are symmetrically arranged at both sides of the voltage division unit.

* * * * *